US008662657B2

(12) United States Patent
Park et al.

(10) Patent No.: US 8,662,657 B2
(45) Date of Patent: Mar. 4, 2014

(54) PRINT PROCESS FOR DUPLEX PRINTING WITH ALTERNATE IMAGING ORDER

(75) Inventors: Daniel Clark Park, West Linn, OR (US); Brent E. Fleming, Aloha, OR (US); Michael E. Jones, West Linn, OR (US); Zhikui Ren, Portland, OR (US)

(73) Assignee: Xerox Corporation, Norwalk, CT (US)

( * ) Notice: Subject to any disclaimer, the term of this patent is extended or adjusted under 35 U.S.C. 154(b) by 326 days.

(21) Appl. No.: 13/082,536

(22) Filed: Apr. 8, 2011

(65) Prior Publication Data

US 2012/0256993 A1 Oct. 11, 2012

(51) Int. Cl.
*B41J 2/01* (2006.01)

(52) U.S. Cl.
USPC ..... 347/103; 101/229; 101/230; 399/401

(58) Field of Classification Search
USPC ..... 347/88, 99, 103, 104; 101/217, 229, 101/230; 399/401
IPC ..... B41J 2/01
See application file for complete search history.

(56) References Cited

U.S. PATENT DOCUMENTS

| | | | | |
|---|---|---|---|---|
| 4,429,990 | A | | 2/1984 | Tamary |
| 4,593,992 | A | | 6/1986 | Yoshinaga et al. |
| 4,920,382 | A | | 4/1990 | Mills et al. |
| 5,132,739 | A | | 7/1992 | Mauer et al. |
| 5,325,155 | A | | 6/1994 | Perry |
| 5,327,204 | A | | 7/1994 | Sculley et al. |
| 5,353,107 | A | | 10/1994 | Sculley et al. |
| 5,523,830 | A | | 6/1996 | Tamura et al. |
| 5,610,721 | A | | 3/1997 | Higuchi et al. |
| 5,835,831 | A | * | 11/1998 | Staudenmayer et al. ..... 399/308 |
| 5,870,650 | A | | 2/1999 | Takahashi et al. |
| 6,035,157 | A | | 3/2000 | Takahashi et al. |
| 6,072,978 | A | | 6/2000 | Wittmann |
| 6,141,524 | A | | 10/2000 | Berkes et al. |
| 6,173,136 | B1 | | 1/2001 | Fuchiwaki et al. |
| 6,176,575 | B1 | | 1/2001 | Crawford et al. |
| 6,263,174 | B1 | | 7/2001 | Fuchiwaki et al. |
| 6,449,455 | B1 | | 9/2002 | Lebold et al. |
| 6,731,891 | B1 | | 5/2004 | Calamita et al. |
| 6,763,219 | B2 | | 7/2004 | Kobayashi et al. |
| 6,954,603 | B2 | | 10/2005 | Brown et al. |
| 6,973,877 | B2 | | 12/2005 | Jensen |
| 7,065,308 | B2 | | 6/2006 | Calamita et al. |
| 7,283,271 | B2 | | 10/2007 | Sesek et al. |
| 7,310,492 | B2 | | 12/2007 | Kimura |
| 7,362,994 | B2 | | 4/2008 | Zess et al. |
| 7,376,378 | B2 | | 5/2008 | Van Bortel |
| 7,390,084 | B2 | | 6/2008 | Folkins |
| 7,458,671 | B2 | | 12/2008 | Leighton et al. |

(Continued)

*Primary Examiner* — Manish S Shah
*Assistant Examiner* — Roger W Pisha, II
(74) *Attorney, Agent, or Firm* — Maginot, Moore & Beck, LLP

(57) ABSTRACT

A method for performing duplex printing with improved throughput has been developed. The method includes forming an image of a back side of a first duplex page and an image of a front side of a second duplex page on an image receiving member. Two recording media sheets are serially passed through a nip to transfer the image of the first duplex page back side to a bare side of a recording media sheet that also bears the image of the front side of the first duplex page on an obverse side and to transfer the image of the second duplex page to a bare side of a recording media sheet that has not been previously printed.

9 Claims, 6 Drawing Sheets

(56) References Cited

U.S. PATENT DOCUMENTS

| | | | | |
|---|---|---|---|---|
| 2005/0111861 | A1* | 5/2005 | Calamita et al. | 399/66 |
| 2006/0066657 | A1 | 3/2006 | Folkins et al. | |
| 2006/0239728 | A1 | 10/2006 | Van Bortel | |
| 2006/0250467 | A1* | 11/2006 | Folkins | 347/103 |
| 2007/0020002 | A1 | 1/2007 | Zess et al. | |
| 2007/0110457 | A1 | 5/2007 | Kato et al. | |
| 2007/0139496 | A1 | 6/2007 | Leighton et al. | |
| 2007/0146459 | A1 | 6/2007 | Gault et al. | |
| 2007/0146460 | A1 | 6/2007 | Gordon et al. | |
| 2007/0146461 | A1 | 6/2007 | Islam et al. | |
| 2009/0027436 | A1 | 1/2009 | McConville et al. | |
| 2010/0020119 | A1* | 1/2010 | McConville | 347/9 |

* cited by examiner

PRINT PROCESS FOR DUPLEX PRINTING WITH ALTERNATE IMAGING ORDER

CROSS REFERENCE

This application cross-references commonly assigned U.S. non-provisional application Ser. No. 12/972,577, filed on Dec. 20, 2010, and entitled "Alternate Imaging Order for Improved Duplex Throughput in a Continuous Print Transfer Printer."

TECHNICAL FIELD

This disclosure relates to indirect printing systems and, more particularly, to control of imaging operations where media pass between a transfix roller and an imaging drum.

BACKGROUND

Drop on demand ink jet printing systems eject ink drops from printhead nozzles in response to pressure pulses generated within the printhead by either piezoelectric devices or thermal transducers, such as resistors. The ink drops are ejected toward a recording medium where each ink drop forms a spot on the recording medium. The printheads have a plurality of inkjet ejectors that are fluidly connected at one end to an ink supplying manifold through an ink channel and at another end to an aperture in an aperture plate. The ink drops are ejected through the apertures, which are sometimes called nozzles.

In a typical piezoelectric ink jet printing system, application of an electrical signal to a piezoelectric transducer causes the transducer to expand. This expansion pushes a diaphragm, which is positioned adjacent the transducer, into a pressure chamber filled with ink received from the manifold. The diaphragm movement urges ink out of the pressure chamber to and through the aperture to eject liquid ink drops. The ejected drops, referred to as pixels, land on an image receiving member opposite the printhead to form an ink image. The respective channels from which the ink drops were ejected are refilled by capillary action from an ink manifold.

In some phase change or solid ink printers, known as indirect printers, the image receiving member is a rotating drum or belt coated with a release agent and the ink is a phase change material that is normally solid at room temperature. In these solid ink printers, the ink image is transferred from the rotating image receiving member to a recording medium, such as paper. The transfer is generally conducted in a nip formed by the rotating image receiving member and a rotating pressure roll, which is also called a transfix roller. One or both of the transfix roller and the recording medium may be heated prior to the recording medium entry in the transfixing nip. As a sheet of paper is transported through the nip, the fully formed image is transferred from the image receiving member to the sheet of paper and concurrently fixed thereon. This technique of using heat and pressure at a nip to transfer and fix an image to a recording medium passing through the nip is typically known as "transfixing," a well-known term in the art, particularly with solid ink technology.

Ink jet printers are capable of producing either simplex or duplex prints. Simplex printing refers to production of an image on only one side of a recording medium. Duplex printing produces an image on each side of a recording medium. In duplex printing, the recording medium passes through the nip for the transfer of a first image onto one side of the recording medium. The medium is then routed on a path that presents the other side of the recording medium to the nip. By passing through the nip again, a second image is transferred to the other side of the medium. When the recording medium passes through the nip the second time, the side on which the first image was transferred is adjacent the transfix roller. Release agent that was transferred to the first side from the image receiving member to the recording medium may now be transferred to the transfix roller. Thus, a duplex print transfers release agent to the transfix roller and multiple duplex prints may cause release agent to accumulate on the transfix roller.

Additional release agent may be applied to the transfix roller if the transfix roller comes into contact with the image receiving member before the recording medium enters the nip. The amount of release agent on the transfix roller may reach a level that enables release agent to be transferred from the transfix roller to the back side of a recording medium while an image is being transfixed to the front side of the recording medium.

When the first side of a duplex print is being made, the back side of the recording medium, which receives the second image, now has release agent on it. The release agent transferred to the back side of the recording medium may interfere with the efficient transfer of ink from the image receiving member to the back side of the recording medium during duplex printing. Consequently, ink may remain on the image receiving member rather than being transferred to the recording medium. This inefficient transfer of ink may subsequently produce an image in which partial or missing pixels are noticeable. This phenomenon is known as image dropout. Additionally, ink remaining on the image receiving member may require the image receiving member to undergo a cleaning cycle. Undesirable transfer of oil to the transfix roller can be exacerbated if the transfix roller significantly contacts the image receiving member.

To aid in the transfer of ink from the image receiving member to the back side of a recording medium, some printers perform the printing process by controlling the timing for the transfix roller movement as well as the speed of the image receiving member to reduce the likelihood that the transfix roller contacts the image receiving member.

In a duplex print mode, the rotation of the image receiving member is halted prior to engaging the transfix roller to the image receiving member. A media sheet is moved between the transfix roller and image receiving member, and the transfix roller loads against the image receiving member with a margin of the media sheet already positioned between the transfix roller and image receiving member to avoid contact between the transfix roller and release agent. Once the media sheet passes between the transfix roller and imaging receiving member, the image receiving member halts again and the transfix roller disengages from the trailing margin of the media sheet without contacting the image receiving member. This operation may be referred to as a "stop and drop or lift" operation referring to the need to stop the rotation of the imaging drum and either drop or lift the transfix roller away from the imaging drum to prevent release agent from transferring to the transfix roller.

The "stop, drop or lift" operation, however, does not operate the image receiving member at its highest speed continuously and therefore, reduces printer throughput during duplex printing operations. Therefore, performing duplex printing in a manner that improves throughput without subjecting image quality to dropout and the like is useful.

SUMMARY

In one embodiment, a method for operating a printer has been developed. The method includes forming a first ink image that is a second side image of a duplex page on an image receiving member and forming a second ink image that is a first side image of another duplex page on the image receiving member. The first ink image and the second ink image are separated by a first inter-document zone and a second inter-document zone. The method also includes moving a transfix roller into engagement with the image receiving member to form a nip as the first ink image on the image receiving member approaches the nip, and continually rotating the image receiving member as the first ink image is transferred to a second side of a first sheet of recording media bearing an ink image on a first side of the first sheet as one of the inter-document zones on the image receiving member moves through the nip and as the second ink image is transferred to a first side of a second sheet of recording media on which no other ink image has been previously transferred.

In another embodiment, a duplex printing system has been developed. The duplex printing system includes an image receiving member, an actuator operatively connected to the image receiving member to rotate the image receiving member, a transfix roller operatively connected to a transfix roller actuator to move the transfix roller into and out of engagement with the image receiving member, a marking unit including at least one printhead, the marking unit being configured to eject ink drops onto the image receiving member, and a controller operatively connected to the marking unit, actuator, and transfix roller actuator. The controller is configured to operate the marking unit to form a first ink image that is a second side image of a duplex page on the image receiving member and form a second ink image that is a first side image of another duplex page on the image receiving member, the first ink image and the second ink image being separated by a first inter-document zone and a second inter-document zone, operate the transfix roller actuator to move the transfix roller into engagement with the image receiving member to form a nip as the first ink image on the image receiving member approaches the nip, and operate the actuator to rotate the image receiving member continually as the first ink image is transferred to a second side of a first sheet of recording media bearing an ink image on a first side of the first sheet as one of the inter-document zones on the image receiving member moves through the nip, and as the second ink image is transferred to a first side of a second sheet of recording media on which no other ink image has been previously transferred.

In another embodiment, a method for operating a printer has been developed. The method includes forming a plurality of ink images in on an image receiving member that are separated by a plurality of inter-document zones. Each ink image in the plurality of ink images is separated from at least one of the other ink images by one of the plurality of inter-document zones. The method also includes moving a transfix roller into engagement with the image receiving member in one of inter-document zones to form a nip as one ink image in the plurality of ink images on the image receiving member approaches the nip, continually rotating the image receiving member as a plurality of sheets of recording media pass through the nip, each ink image in the plurality of ink images being transferred to a side of one sheet in the plurality of sheets on which no other ink image has been previously transferred, and contacting only a portion of a surface of the transfix roller that contacts the one of the inter-document zones with each of the other inter-document zones as the plurality of sheets pass through the nip.

In still another embodiment, a method for operating rollers to fix ink images to media sheets in a printer has been developed. The method includes forming an ink image on a second side of a first media sheet, a first side of the first media sheet having an ink image that is fixed to the first media sheet, forming another ink image on a second media sheet, applying release agent to a first pressure roller, engaging the first pressure roller with a second pressure roller to form a nip as the first media sheet approaches the nip, rotating the first pressure roller and the second pressure roller as the first media sheet moves through the nip to enable the ink image on the second side of the first media sheet to be fixed to the first media sheet by the first pressure roller and to transfer a release agent from the second pressure roller to the first side of the first media sheet, continuing to rotate the first pressure roller and the second pressure roller for a predetermined time after the first media sheet exits the nip and prior to the second media sheet entering the nip, a portion of the release agent on the first pressure roller transferring to the second pressure roller, and rotating the first pressure roller and the second pressure roller as the second media sheet moves through the nip to enable the ink image on the second media sheet to be fixed to the second media sheet by the first pressure roller without transferring the portion of the release agent transferred to the second pressure roller to a surface of the second media sheet engaging the second pressure roller. The second pressure roller has a circumference that is equivalent to a sum of a length of the first media sheet and a product of a linear velocity of the second pressure roller and the predetermined time.

BRIEF DESCRIPTION OF THE DRAWINGS

The foregoing aspects and other features of a system that evaluates image content of images to control the printing process timing sequence are explained in the following description taken in connection with the accompanying drawings.

DETAILED DESCRIPTION

Figure 1:
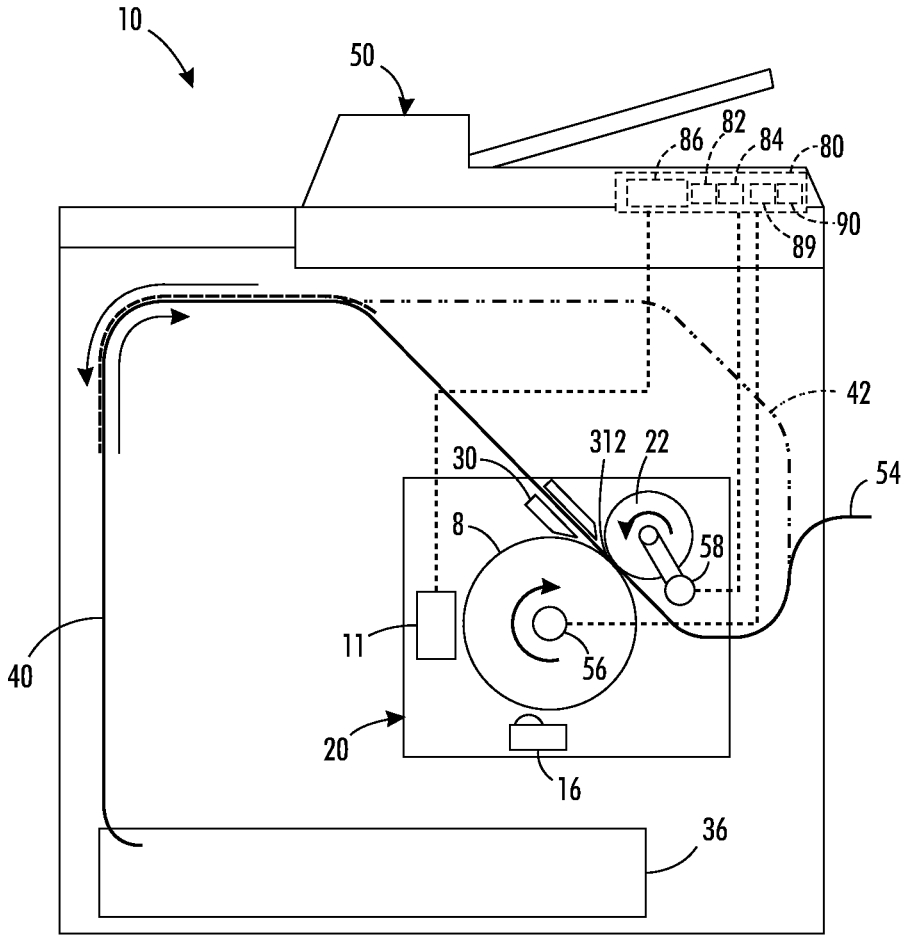
FIG. 1 is a schematic diagram of an indirect inkjet printer including a transfix roller with a circumference that is equivalent to the sum of a length of an ink image formed on an imaging drum and the length of a second inter-document zone.

For a general understanding of the environment for the system and method disclosed herein as well as the details for the system and method, reference is made to the drawings. In the drawings, like reference numerals have been used throughout to designate like elements. As used herein, the word "printer" encompasses any apparatus that performs a print outputting function for any purpose, such as a digital copier, bookmaking machine, facsimile machine, a multi-function machine, or the like. The systems and methods described below may be used with various indirect printer embodiments where ink images are formed on an intermediate image receiving member, such as a rotating imaging drum or belt, and the ink images are subsequently transfixed on media sheets. A "media sheet" or "recording medium" as used in this description may refer to any type and size of medium that printers in the art create images on, with one common example being letter sized printer paper. Each media sheet includes two sides, and each side may receive an ink image corresponding to one printed page.

FIG. 1 is a schematic diagram of an indirect printer 10 that is configured to perform duplex imaging operations on multiple media sheets. The printer 10 includes a media supply unit 36, media supply path 40, duplex media path 42, media finisher 54, controller 80, and an imaging unit 20. The imaging unit 20 includes an imaging drum 8, imaging drum actuator 56, marking unit 11, drum maintenance unit 16, transfix roller 22, transfix actuator arm 58, and preheater 30.

Marking unit 11 may include one or more inkjet printheads that eject ink drops onto the imaging drum 8 to form ink images. The marking unit 11 may include multiple printheads that are configured to eject drops of inks having various colors to form multi-color images. In one configuration, the marking unit 11 ejects inks having cyan, magenta, yellow, and black (CMYK) colors that combine to form multi-color images. Different inkjet printer configurations may use solvent based inks, aqueous inks, UV curable inks, gel inks, phase-change inks, and any other form of ink that is suitable for use with indirect printing.

The marking unit 11 forms images on the surface of the imaging drum 8 as the imaging drum 8 rotates past the marking unit 11. An actuator 56 may rotate the imaging drum 8 past the marking unit 11 one or more times as the marking unit 11 ejects ink drops to form ink images on the drum. In some printer embodiments, the actuator 56 rotates the imaging drum 8 at a higher angular velocity while the marking unit 11 forms ink images on the imaging drum 8 than during transfix operations when the ink images are transferred to media sheets.

The imaging drum 8 is configured to receive and hold ink images that are transfixed to media sheets passing through a nip formed between the imaging drum 8 and the transfix roller 22. Prior to forming latent images on the imaging drum 8, the drum maintenance unit 16 applies a coating of release agent to the surface of the imaging drum 8. The release agent is a chemical, such as silicone oil, that prevents latent ink images formed on the imaging drum from adhering to the imaging drum 8 instead of transfixing to the media sheets. The ink in the ink images floats on the layer of release agent prior to being transferred to the media sheet.

In one embodiment, the surface area of the imaging drum 8 holds two ink images corresponding to two media pages simultaneously. This configuration may be referred to as a two-pitch configuration, and the imaging drum 8 may be referred to as a two-pitch image receiving member. The marking unit 11 positions the two ink images on the imaging drum 8 so that two non-imaged portions of the imaging drum 8, referred to as inter-document zones, separate the ink images. The inter-document zones prevent ink from each of the ink images formed on the imaging drum 8 from mixing and degrading image quality. The inter-document zones also provide a location where the transfix roller 22 may engage the imaging drum 8 without transferring ink to the surface of the transfix roller 22.

In an example embodiment, the imaging drum 8 has a circumference of 472 mm. This enables the imaging drum 8 to hold two latent images corresponding to A4 size media sheets that are each 210 mm long, with two inter-document zones having a total length of 52 mm, or two U.S. Letter sized media sheets that are each 216 mm long with two inter-document zones having a total length of 40 mm. As seen below, each inter-document zone may have a different length. While drum 8 is configured to hold two latent ink images, alternative drum configurations may hold three or more latent ink images for media sheets of various dimensions. The number of inter-document zones in the alternative drum embodiments is equivalent to the number of latent ink images formed on the imaging drum. Alternative image receiving member embodiments have different dimensions to accommodate various sizes and numbers of ink images and different inter-document zone sizes.

Transfix roller 22 is configured to apply pressure to a media sheet as the media sheet contacts the imaging drum 8 to transfer a latent ink image formed on the imaging drum 8 to the media sheet. The transfix roller 22 is movable between a position where the transfix roller 22 engages the imaging drum 8 to form a nip 312, and a second position where the transfix roller 22 is removed from engagement with the imaging drum 8. Printer 10 includes an actuator arm 58 that moves the transfix roller between the two positions. The actuator arm 58 moves the transfix roller 22 out of engagement with the imaging drum 8 during image formation as the marking unit 11 forms ink images on the imaging drum 8, and moves the transfix roller 22 into engagement with the imaging drum 8 to transfix the ink images on media sheets. The transfix roller 22 is not directly connected to a motor that rotates the transfix roller 22, but the transfix roller 22 rotates as the imaging drum 8 rotates when engaged to the imaging drum as seen in FIG. 1.

Figure 3A:
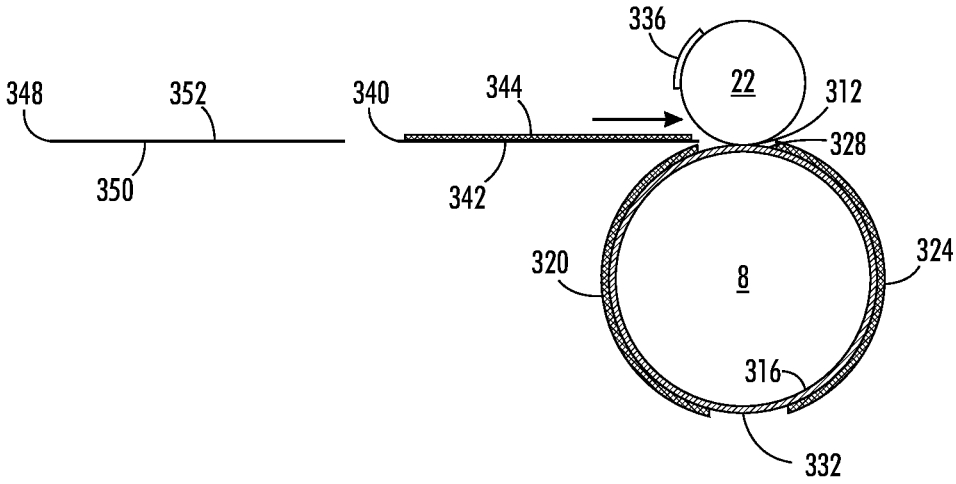
FIG. 3A is a schematic view of the transfix roller and imaging drum of FIG. 1.

Referring to FIG. 3A, transfix roller 22 and imaging drum 8 are depicted in more detail. A release agent layer 316 coats the imaging drum 8, and ink images 320 and 324 are formed on the layer of release agent 316. The first inter-document zone 328 and second inter-document zone 332 separate the ink images 320 and 324. In the embodiment of FIG. 3A, the first inter-document zone 328 is longer than the second inter-document zone 332, although the second inter-document zone 332 is longer than or equal in length to the first inter-document 328 zone in alternative configurations. The transfix roller 22 has a circumference that is equivalent to the sum of the length of the second inter-document zone 332 and one of the media sheets 340 or 348. In a configuration for printing to a U.S. Letter sized media sheet of 216 mm and a second inter-document-zone of 29 mm, the transfix roller has a corresponding circumference of 245 mm. The size of the second inter-document zone 332 may be adjusted to accommodate media sheets of various sizes within a predetermined range of inter-document zone sizes. For example, the transfix roller having a circumference of 245 mm may also accommodate size A4 media with a length of 210 mm and an inter-document zone size of 35 mm.

With reference to FIG. 1, operation and control of the various subsystems, components and functions of the machine or printer 10 are performed with the aid of a controller or electronic subsystem (ESS) 80. The ESS or controller 80, for example, is a self-contained, dedicated mini-computer having a central processor unit (CPU) 82 with electronic storage 84, and a display or user interface (UI) 86. The ESS or controller 80, for example, includes a sensor input and control circuit as well as a pixel placement and control circuit 89. In addition, the CPU 82 reads, captures, prepares, and manages the image data flow between image input sources, such as scanning system 50, or an online or a work station connection 90, and the marking unit 11. As such, the ESS or controller 80 is the main multi-tasking processor for operating and controlling all of the other machine subsystems and functions, including the duplex printing process discussed herein.

The controller 80 may be implemented with general or specialized programmable processors that execute programmed instructions. The instructions and data required to perform the programmed functions may be stored in memory associated with the processors or controllers. The processors, their memories, and interface circuitry configure the controllers to perform the printing processes, described more fully below, that enable the imaging drum 8 to continue to rotate at full speed during duplex printing operations. These components may be provided on a printed circuit card or provided as a circuit in an application specific integrated circuit (ASIC). Each of the circuits may be implemented with a separate processor or multiple circuits may be implemented on the same processor. Alternatively, the circuits may be implemented with discrete components or circuits provided in VLSI circuits. Also, the circuits described herein may be implemented with a combination of processors, ASICs, discrete components, or VLSI circuits. Multiple controllers configured to communicate with a main controller 80 may also be used.

Controller 80 is operatively connected to various components in the printer 10, including the marking unit 11, imaging drum actuator 56, and transfix roller actuator arm 58. The CPU 82 in controller 80 obtains programmed instructions from the electronic storage 82 and executes the programmed instructions to perform various operations in the printer 10. The controller 80 operates the transfix actuator arm 58 to move the transfix roller 22 in and out of engagement with the imaging drum 8. The controller 80 also operates the imaging drum actuator 56 to rotate the imaging drum at one or more rotational velocities. The controller 80 also operates the marking unit 11 to form ink images on the imaging drum 8, and operates the media paths 40 and 42 to control the movement of media sheets through the printer 10.

In one operating mode, printer 10 is configured to perform a duplex imaging operation using an alternate media order. In the alternate media order process, a first and second media sheet are withdrawn from the media supply unit 36 and pass through the media supply path 40 to the imaging unit 20 for first-side imaging. Imaging drum 8 holds two ink images that are transfixed to the first side of the first sheet and the first side of the second sheet. Both media sheets then pass through the duplex media path 42 to orient the media sheets for second-side printing, and two images are formed on the imaging drum 8. In the alternate media order process, the first sheet, having a first imaged side and a blank second side, moves through the duplex media path 42 to return to the imaging unit 20 for second-side imaging. A third media sheet is withdrawn from the media supply unit 36 and moves behind the first media sheet as the first media sheet and third media sheet enter the marking unit 20. The second side of the first media sheet and a first side of the third media sheet receive ink images from the imaging drum 8.

The alternate media order process introduces the third media sheet prior to imaging both sides of the second media sheet to improve the throughput of the printer 10. The media path from the media supply 36 provides a blank media sheet faster than the duplex path 42 provides a media sheet for second-side printing. Thus, the alternate media order process provides pairs of media sheets to the imaging unit 20 at a faster rate than the duplex unit 42 provides each of the first-side imaged sheets for each imaging operation.

While the first and third sheets are imaged, the second sheet moves through the duplex media path 42 and is available for second-side printing along with a first-side printing of a fourth media sheet. While the second and fourth media sheets are imaged, the third media sheet passes through the duplex media path 42. The printer 10 may continue ordering sheets in this manner for duplex print jobs having as many pages as the printer 10 is configured to accommodate.

In another operating mode, printer 10 prints a first side image on a first media sheet and passes the single media sheet through the duplex media path 42. The printer 10 then forms two images on the imaging drum 8, passes the first media sheet through the nip for second-side printing and a second media sheet for first-side printing. The second media sheet passes through the duplex media path 42 and the media path 40 carries a third media sheet from the media supply 36 following the second media sheet. The printer 10 may then perform imaging on the second side of the second sheet and the first side of the third sheet. The printing process may continue in this manner for duplex print jobs having as many pages as the printer 10 is configured to accommodate.

Figure 2:
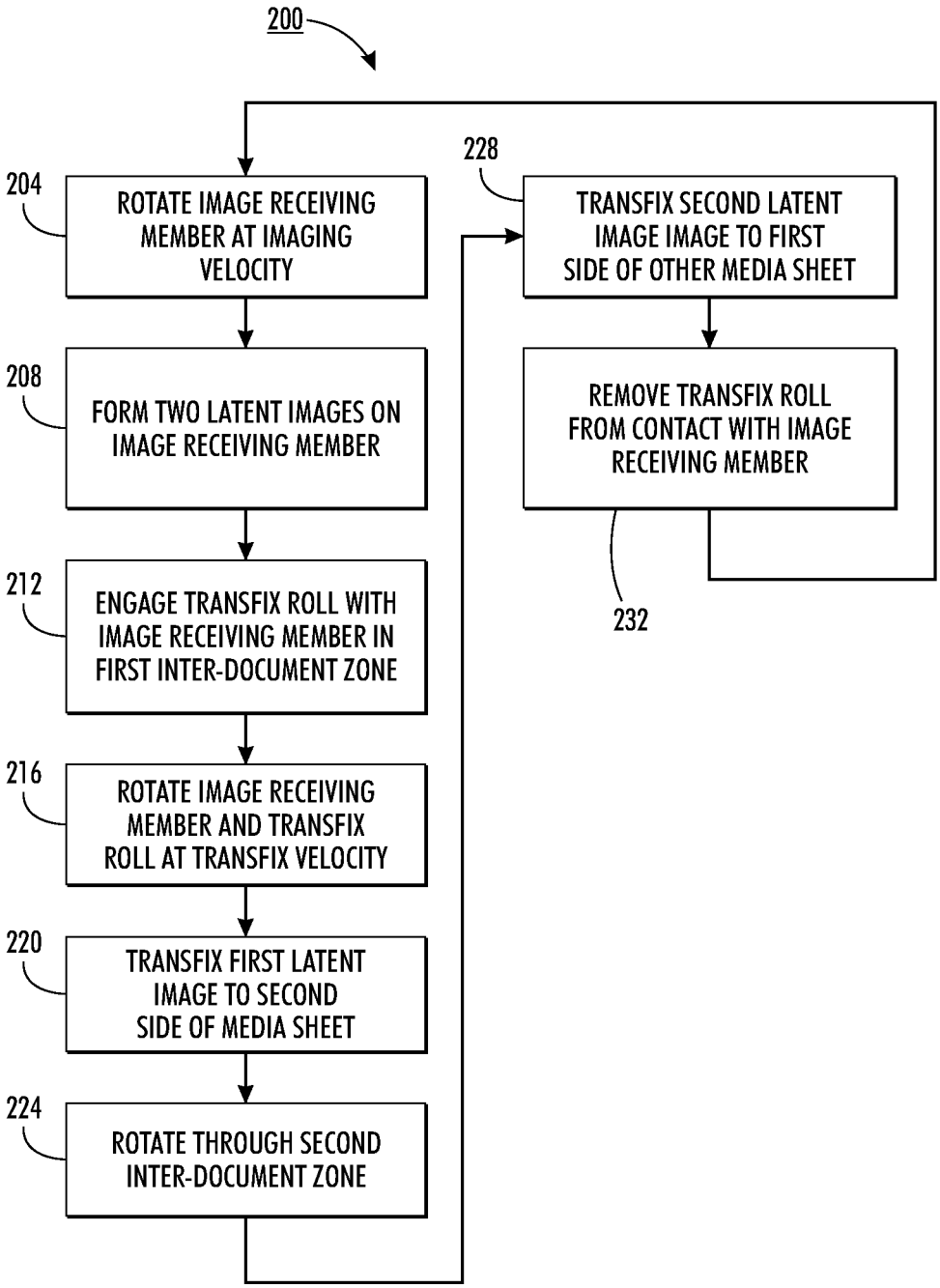
FIG. 2 is a flow diagram for a process of transfixing images in a duplex printing mode in an indirect inkjet printer.

FIG. 2 is a block diagram of a process 200 for forming ink images on an image receiving member and for transfixing ink images to media sheets with improved throughput. As described in more detail below, the image receiving member rotates at a constant velocity during the transfix process 200 and the transfix roller engages the image receiving member as two media sheets pass through the nip formed between the image receiving member and the transfix roller. Printer 10 is an example of one printer embodiment that may perform process 200 and FIG. 3A-FIG. 3E depict the rotation of imaging drum 8 and transfix roller 22 as two media sheets receive ink images during the transfix process 200.

Process 200 begins by rotating the image receiving member at a predetermined velocity for imaging (block 204). Using printer 10 in FIG. 1 as an example, actuator 56 rotates the imaging drum 8. Once the image receiving member is rotating at the imaging velocity, the printer forms two ink images on the image receiving member (block 208). In printer 10, the marking unit 11 forms two ink images on the imaging drum 8 as the imaging drum 8 rotates at the imaging velocity. The ink images float on a layer of release agent that coats the imaging drum 8. Each of the ink images corresponds to one side of a printed media sheet. As seen in FIG. 3A, the ink images are separated by the inter-document zones 328 and 332 on the imaging drum 8.

Once the ink images are formed on the image receiving member, the transfix roller engages, or contacts, the image receiving member in the first inter-document zone (block 212). Referring again to FIG. 3A, transfix roller 22 engages the imaging drum 8 in the first inter-document zone 328. The transfix roller 22 and imaging drum 8 form a nip 312 that accepts media sheets 340 and 348 for a transfix operation. The transfix roller 22 contacts release agent 316 in the first inter-document zone 328 as well. The transfix roller 22 may also have residual release agent, seen here as release agent 336, that was transferred to the transfix roller 22 in an earlier transfix operation. The residual release agent 336 may adhere to any portion of the transfix roller 22.

Figure 3B:
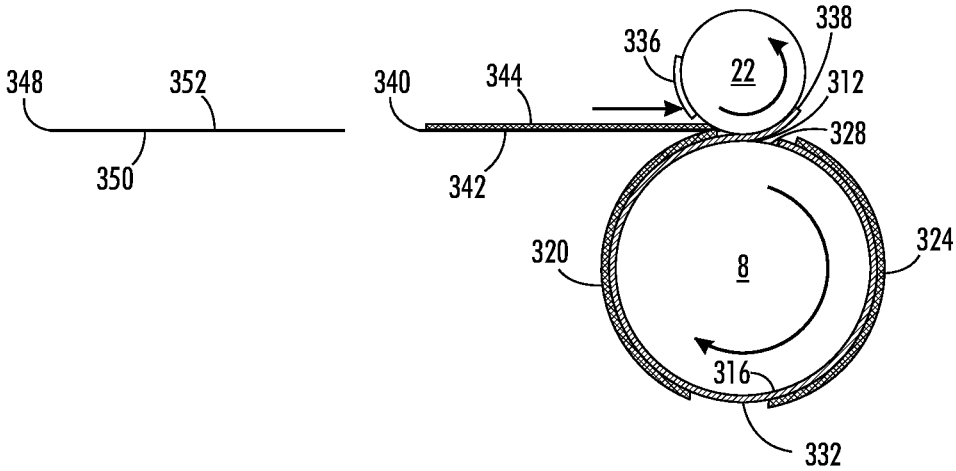
FIG. 3B is a schematic view of the transfix roller and imaging drum of FIG. 3A as the imaging drum and transfix roller rotate to transfix an image on a second side of a first media sheet.
Figure 3C:
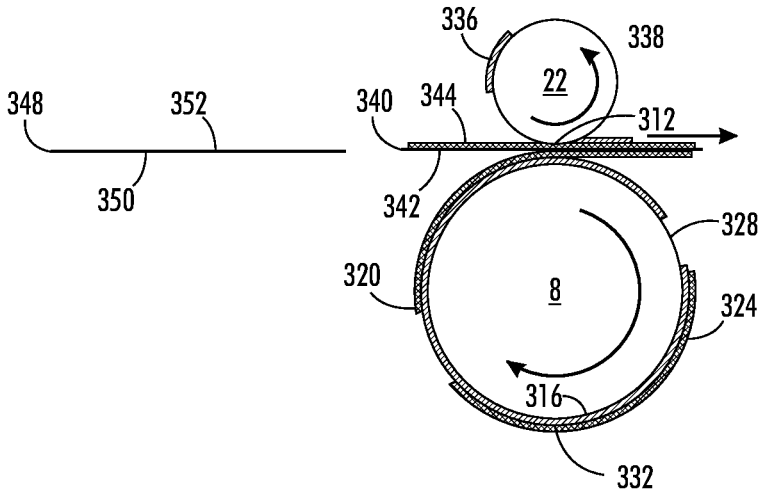
FIG. 3C is a schematic view of the transfix roller and imaging drum of FIG. 3A-FIG. 3B as the second side of the first media sheet is transfixed and the transfix roller transfers release agent to the first side of the first media sheet.
Figure 3D:
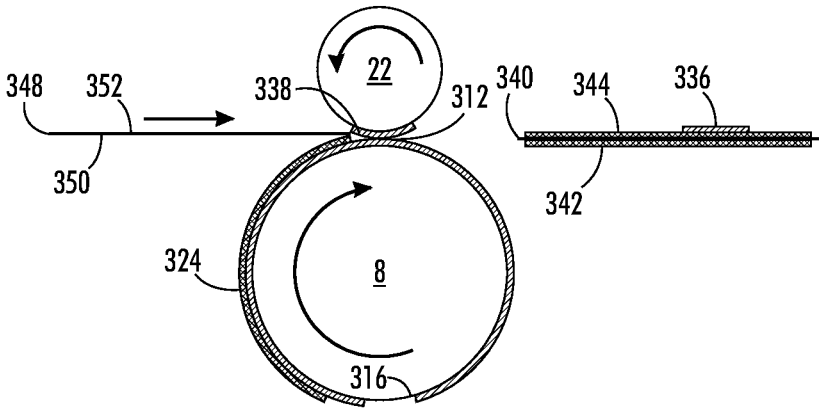
FIG. 3D is a schematic view of the transfix roller and imaging drum of FIG. 3A-FIG. 3C as the transfix roller contacts an inter-document zone on the image receiving member after the first sheet is transfixed.

Once the transfix roller 22 is engaged with the imaging drum 8, the imaging drum 8 is rotated at a transfix velocity (block 216). In printer 10, the actuator 56 rotates the imaging drum at the transfix velocity, and friction between the imaging drum and transfix roller 22 causes the transfix roller 22 to rotate. As seen in FIG. 3B-FIG. 3C, media sheet 340 moves through the nip 312 as the portion of the imaging drum 8 carrying the first ink image 320 rotates the nip 312. The transfix roller 22 applies pressure to the media sheet 340 at the nip 312 that enables the latent image 320 to transfer onto a second side 342 of the media sheet 340 (block 220). The first side 344 of the media sheet 340 has been imaged in a previous transfix operation. As the transfix roller 22 and imaging drum 8 rotate prior to accepting the media sheet 340, a portion of the release agent 316 formed on the imaging drum 8 transfers to the transfix roller 22. The transferred release agent 338 adheres to the portion of the transfix roller 22 that contacts the first inter-document zone 328 prior to the first media page 340 entering the nip 312.

During the transfix operation of media sheet 340, the transfix roller rotates in engagement with the imaged side 344 of media sheet 340. As seen in FIG. 3C, the residual release agent 336 transfers from the transfix roller 22 to the imaged side 344 of the media sheet 340 during the transfix operation. The imaged side 344 is opposite the non-imaged side 342 that receives the latent ink image 320. Because the media sheet 340 has already been imaged on side 344, the release agent 336 does not negatively affect the image quality of the ink image formed on the media sheet 340.

After the second side 342 of media sheet 340 is transfixed, the imaging drum 8 and transfix roller 22 continue rotating at the transfix velocity through the second inter-document zone 332 (block 224). As described above, the transfix roller 22 has a circumference that is equivalent to the length of the second inter-document zone 332 and one of the media sheets 340 or 348. The imaging drum 8 rotates a corresponding portion of the circumference of the imaging drum 8 including the second inter-document zone 332 and the first ink image 320 as shown in FIG. 3A-FIG. 3D. Consequently, the transfix roller 22 completes a single rotation when first media sheet 340 and the second inter-document zone 332 pass the nip 312, and the same portion of the transfix roller 22 that contacted the first inter-document zone 328 also contacts the second inter-document zone 332. The release agent 338 transferred to the transfix roller 22 from the first inter-document zone 328 also passes through the second inter-document zone 332.

Process 200 continues by transfixing the second ink image to one side of the media sheet 348 (block 228). The media sheet 348 passes through the nip 312 as the portion of the imaging drum 8 carrying the second ink image 324 rotates through the nip 312. The transfix roller 22 applies pressure to the media sheet 340 at the nip 312 that enables the image 324 to transfer onto a first side 350 of the media sheet 348.

Figure 3E:
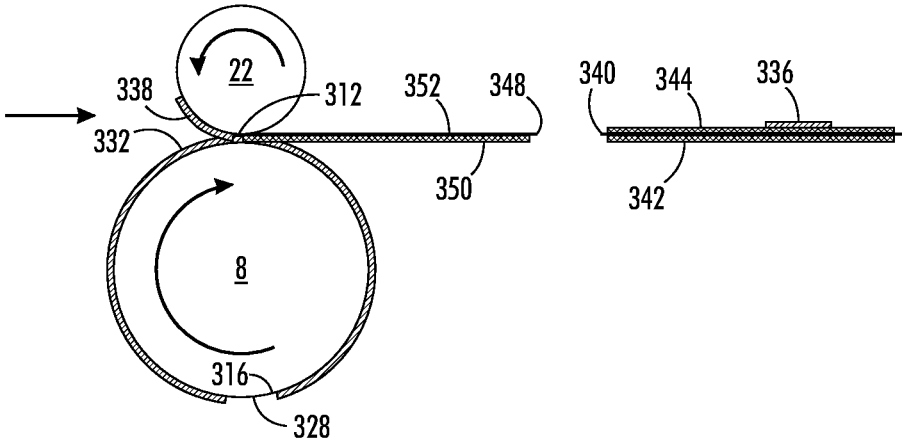
FIG. 3E is a schematic view of the transfix roller and imaging drum of FIG. 3A-FIG. 3D after the first side of the third media sheet is transfixed.

During the transfix process of the first side 350 of the media sheet 348, the transfix roller 22 contacts the non-imaged side 352 of the media sheet 348. The portion of the transfix roller 22 that carries the release agent 338, however, does not make contact with the media sheet 348 as the media sheet 348 passes through the nip 312. As seen in FIG. 3E, the media sheet 348 exits the nip 312 just as the portion of the transfix roller 22 carrying the release agent 338 rotates through the nip 312. The selected circumference of the transfix roller being the sum of the lengths of the second inter-document zone 332 and the first media sheet 340 enables the entire media sheet 348 to pass through the nip 312 without contacting the portion of the transfix roller 22 carrying the release agent 338. Thus, the second side 352 of the media sheet 348 does not carry release agent and another ink image may be transfixed to the second side 352 during a subsequent transfix operation without adverse print quality effects due to release agent being deposited on the second side 352.

After the second ink image is transfixed to the first side of the media sheet, the transfix roller 22 moves away from engagement with the imaging drum 8 (block 232). Process 200 may repeat one or more times to form and transfix additional pairs of ink images onto media sheets. When process 200 repeats, the release agent 338 that was transferred to the transfix roller 22 during the first iteration of process 200 may be transferred to an imaged side of a media sheet as seen in FIG. 3C. In the example described above, media sheet 348 may return for imaging of the second side 352 followed by another blank media sheet. When the printer 10 operates using the alternate media order process described above, each transfix operation is performed on the second side of sheet N in the print process, and the first side of sheet N+2 in the print process. For example, process 200 may form and transfix images on the second side of sheet one and the first side of sheet three in a print job. The next iteration of process 200 forms and transfixes images on the second side of the second sheet and the first side of the fourth sheet, with the process 200 repeating as specified by the length of the print job. In either configuration, each iteration of process 200 prints to a second side of one media sheet already having a first printed side followed by a first side of a blank media sheet.

Process 200 enables the imaging drum 8 and transfix roller 22 to rotate continuously at the transfix velocity to transfix both latent ink images formed on the imaging drum 8 onto media sheets. Unlike previous printer transfix operations, no need exists to halt the imaging drum 8 or to remove the transfix roller 22 from engagement with the imaging drum 8 during the transfix operation. Additionally, the rotation of the imaging drum 8 need not be halted between the imaging operation of block 208 and the engagement of the transfix roller 22 with the imaging drum 8 of block 212. The continual rotation of the imaging drum 8 eliminates throughput slowdown due to typical "stop and drop or lift" transfix roller engagement. The release agent 338 that is transferred to the transfix roller 22 does not contact a side of a media sheet prior to transfixing an image on the media sheet. Thus, process 200 maintains the quality of images formed on the media sheets since release agent is only transferred to sides of media sheets after ink images are formed on the media sheet. In the duplex printing mode 200, the rotational transfix speed of the imaging drum 8 may be the same as a transfix speed used in a simplex mode that transfixes images to only a single side of each media sheet. The rotational speed of the image receiving member in the duplex mode and simplex mode are both the fastest operating speed for transfixing images in the printer. These speeds enable the printer to transfix images at the same speed in the duplex mode as in the simplex mode.

While process 200 is described with reference to printer 10, alternative printer embodiments may be suited for use with the process 200 as well. For example, lithographic and other indirect imaging systems that form latent images on a moving image receiving member are modified in other embodiments to operate as shown in process 200. Various media paths and duplexing devices are used in alternative embodiments to provide media sheets for duplex imaging as well. The diameters and circumferences of the image receiving members and transfix rollers are selected to accommodate media sheets of various sizes as well.

Printer 10 and process 200 may also accommodate image receiving members that are configured to hold three or more latent ink images for use in a duplex printing process. For example, if the imaging drum 8 in printer 10 has a three-pitch configuration, then three latent ink images are formed on the imaging drum 8 separated by three inter-document zones. The corresponding circumference of the transfix roller 22 is the sum of the length of one media sheet configured for use with the printer 10 and the length of the second and third inter-document zones on the image receiving member 8 that the transfix roller 22 contacts between sheets. In a three-pitch configuration, three media sheets have a single side transfixed, with the first media sheet passed through the nip already having an imaged formed on the side that contacts the transfix roller 22. The transfix roller 22 may transfer any accumulated release agent to the imaged side of the first sheet. For all subsequent sheets passing through the nip, only the portion of the transfix roller 22 that contacted the first inter-document zone on the image receiving member 8 contacts each of the other inter-document zones as they pass through the nip. The remaining portion of the transfix roller 22 that is free of release agent contacts the remaining media sheets during the transfix operation. Consequently, the transfix roller 22 does not transfer release agent to any of the remaining media sheets during the transfix operation. A similar arrangement may be used for image receiving members that are configured to hold four or more latent ink images.

In another embodiment, a direct printer is configured for duplex printing. In a direct printer, ink images are formed directly on media sheets such as by ejecting ink drops directly onto each media sheet. After the ink images are formed on the media sheets, the media sheets pass through a nip formed between two pressure rollers. The pressure rollers apply pressure to fuse or fix the ink image to the sheet. Prior to being fixed to the media sheet, the ink image may transfer to structures in the printer that contact the ink image. The pressure roller that contacts the ink image during the fixing process is coated with a layer of release agent to prevent the ink from transferring to the pressure roller during the fixing process. Some of the release agent on the pressure roller that contacts the ink images transfers to the second pressure roller when the pressure rollers engage each other in the absence of a media sheet. In a duplex printing system, the release agent from the second pressure roller may transfer to a blank side of a media sheet prior to the printer forming an image on the blank side. The release agent transferred to the blank side of the media sheets interferes with the formation of the duplexed ink image on the media sheet.

Figure 4A:
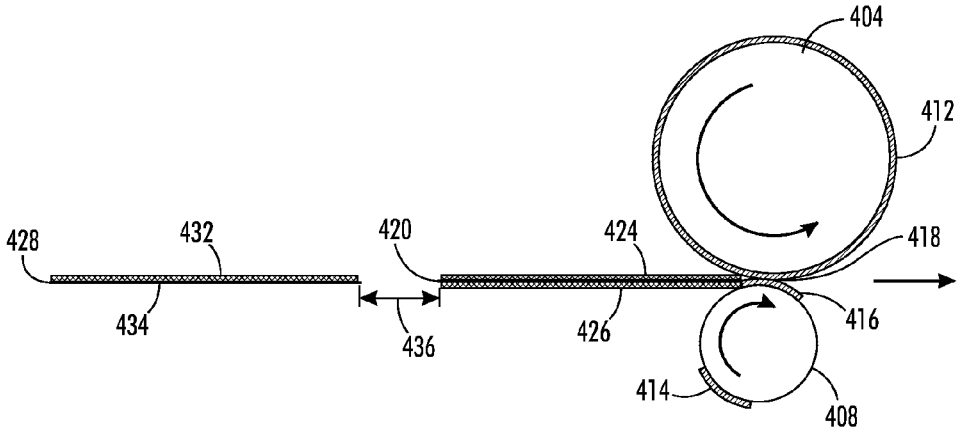
FIG. 4A is a schematic view of two pressure rollers that are configured to apply pressure to a plurality of media sheets after an ink image is formed on each of the media sheets.
Figure 4B:
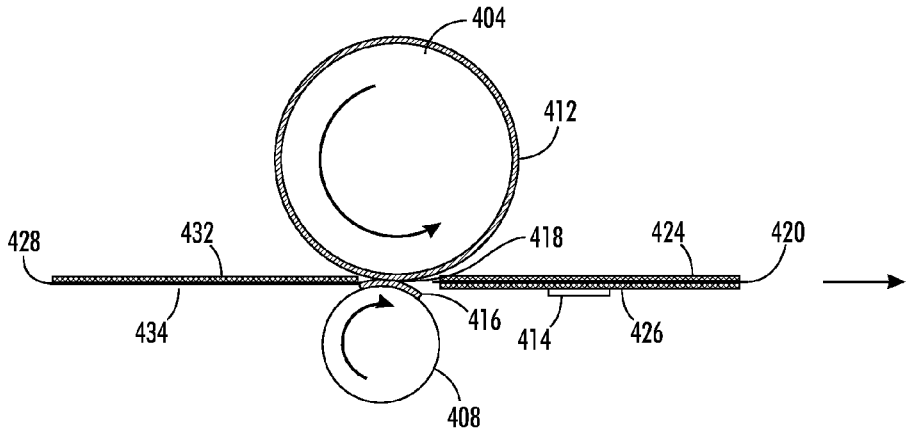
FIG. 4B is a schematic view of the pressure rollers of FIG. 4A as a second media sheet approaches the pressure rollers after a first media sheet has passed between the pressure rollers.

FIGS. 4A and 4B depict a first pressure roller 404 and a second pressure roller 408 that are configured to fix ink images to media sheets and prevent a transfer of release agent onto blank sides of media sheets in a direct printer. Pressure rollers 404 and 408 engage each other to form a nip 418. The first pressure roller 404 is coated with a layer of a release agent 412. Pressure rollers 404 and 408 rotate continually as media sheets 420 and 428 pass through the nip 418. The media sheets are separated by a gap 436 having a predetermined length. In the example of FIG. 4A, media sheet 420 has a first side image 424 that has been fixed in an earlier pass through the nip 418 and a second side image 426 that is entering the nip 418, while media sheet 428 has a first side image 432 and a blank second side 434. In the configuration of FIG. 4A and FIG. 4B, the second pressure roller 408 bears residual release agent 414, that was transferred to the second pressure roller 408 in an earlier fixing operation. The residual release agent 414 may adhere to any portion of the second pressure roller 408.

Referring to FIG. 4A, a portion of the second pressure roller 408 bears release agent 416 that is transferred from the layer of release agent 412 that coats the first pressure roller 404. The release agent 416 transfers to the second pressure roller 408 when the pressure rollers 404 and 408 rotate in engagement with one another through gaps, such as gap 436, between media sheets. For example, as seen in FIG. 4B, the pressure rollers 404 and 408 continue to rotate after the first media sheet 420 exits the nip 418 and prior to the second media sheet 428 entering the nip 418. The length of the release agent 416 that is transferred to the second pressure roller 408 corresponds to the circumferential distance that the first pressure roller 404 and second pressure roller 408 rotate while the second media sheet 428 approaches the nip 418.

To avoid transfer of release agent from the second pressure roller 408 to blank sides of media sheets, the circumference of the second pressure roller 408 is configured to be equivalent to the sum of a length of the media sheet passing through the nip 418 and the circumferential length of the portion of the second pressure roller 408 that bears the transferred release agent 416. The circumferential length of the second pressure roller 408 that bears the release agent 416 is equivalent to the linear velocity of the first and second pressure rollers 404 and 408 multiplied by the time that elapses between a first media sheet exiting the nip 418 and a second media sheet entering the nip 418. In an embodiment where the media sheets 420 and 428 move at a linear velocity that is equivalent to the linear velocities of pressure rollers 404 and 408, the circumferential length of the second pressure roller 408 that holds the release agent 416 is equivalent to the length of the gap 436.

In the embodiment of FIG. 4A and FIG. 4B, the circumference of the second pressure roller 408 is selected to avoid the transfer of release agent 416 from the second pressure roller 408 to the second side of a media sheet passing through the nip 418. In operation, the first pressure roller 404 and the second pressure roller 408 rotate continually as media sheets 420 and 428 pass through the nip 418. Media sheet 420 enters the nip 418 as the release agent 416 on the second pressure roller 408 exits the nip 418. The previously fixed image 426 on the media sheet 420 engages the second pressure roller 408 as the media sheet 420 moves through the nip 418. As the first media sheet 420 passes through the nip 418, the residual release agent 414 on the second pressure roller 408 transfers from the second pressure roller to the media sheet 420 as shown in FIG. 4B.

The portion of the second pressure roller 408 bearing the release agent 416 exits the nip 418 as each media sheet enters the nip 418, and the release agent 416 returns to the nip 418 as each media sheet exits the nip 418. As seen in FIG. 4B, the blank side 434 of media sheet 438 engages only a portion of the second pressure roller 408 that is free of the release agent, while the portion of the second pressure roller 408 bearing the release agent 416 away from the nip 418 as the second media sheet 428 enters the nip 418. In configurations where the second pressure roller 408 bears residual release agent, the first media sheet to pass through the nip 418 receives residual release agent from the second pressure roller 408. The residual release agent 414 that is transferred to the first media sheet 420 does not affect the image quality of the previously imaged side 426. While FIG. 4A and FIG. 4B depict two media sheets, the media rollers 404 and 408 are configured to accept three or more media sheets for fixation while preventing a transfer of release agent to the back side of any media sheets that pass through the nip 418 subsequent to the first media sheet passing through the nip 418.

The configuration of pressure rollers 404 and 408 may accommodate media sheets of different lengths within an operational range by adjusting the length of the circumferential portion of the second pressure roller 408 that bears release agent 416. For example, a U.S. Letter sized media sheet has a length of 216 mm while an A4 sized media sheet has a length of 210 mm. A single pressure roller 408 having a circumference of 250 mm accommodates both media sizes with a 34 mm or 40 mm circumferential portion of the pressure roller 408 bearing the release agent, respectively. The rotational velocity of the pressure rollers 404 and 408 and/or the gap between media sheets fed into the nip formed by the pressure rollers 404 and 408 are adjusted to enable fixation of different sized media sheets.

It will be appreciated that variations of the above-disclosed and other features and functions, or alternatives thereof, may by desirably combined into many other different systems or applications. Also, that various presently unforeseen or unanticipated alternatives, modifications, variations or improvements therein may be subsequently made by those skilled in the art which are also intended to be encompassed by the following claims.

What is claimed is:

1. A method of operating a printer comprising:

forming a first ink image that is a second side image of a duplex page on an image receiving member and forming a second ink image that is a first side image of another duplex page on the image receiving member, the first ink image and the second ink image being separated by a first inter-document zone and a second inter-document zone;

moving a transfix roller into engagement with the image receiving member to form a nip as the first ink image on the image receiving member approaches the nip; and continually rotating the image receiving member as the first ink image is transferred to a second side of a first sheet of recording media bearing an ink image on a first side of the first sheet as one of the inter-document zones on the image receiving member moves through the nip, and as the second ink image is transferred to a first side of a second sheet of recording media on which no other ink image has been previously transferred.

2. The method of claim 1 further comprising:

transferring a release agent from a portion of the transfix roller to the first side of the first sheet as the first ink image is transferred to the second side of the first sheet in the nip.

3. The method of claim 1 further comprising:

completing one complete rotation of the transfix roller in response to the first sheet and the second inter-document zone moving through the nip while engaged with the transfix roller.

4. The method of claim 1, wherein the image receiving member rotates at a speed that is a speed at which simplex printing is performed in the printer.

5. The method of claim 1, wherein the image receiving member rotates at a speed that is a fastest speed for image transfer in the printer.

6. The method of claim 1, wherein the movement of the transfix roller further comprises:

contacting the first inter-document zone on the image receiving member as the first image approaches the nip.

7. The method of claim 1 further comprising:

transferring a release agent from a release agent layer formed on the image receiving member to a same portion of the transfix roller as the first inter-document zone and the second inter-document zone rotate through the nip.

8. The method of claim 1 further comprising:

disengaging the transfix roller from the image receiving member;

forming a third ink image that is a second side image of the other duplex page on the image receiving member and forming a fourth ink image that is a first side image of a third duplex page on the image receiving member, the third ink image and the fourth ink image being separated by the first inter-document zone and the second inter-document zone;

moving the transfix roller into engagement with the image receiving member to form the nip as the third ink image on the image receiving member approaches the nip;

continually rotating the image receiving member as the third ink image is transferred to a second side of the second sheet of recording media bearing the second ink image on the first side of the second sheet as one of the inter-document zones on the image receiving member moves through the nip, and as the fourth ink image is transferred to a first side of a third sheet of recording media on which no other ink image has been previously transferred; and transferring a release agent on the transfix roller to the first side of the second sheet as the third ink image is transferred to the second side of the second sheet in the nip.

9. The method of claim 8 further comprising:

transferring a release agent from a release agent layer formed on the image receiving member to a same portion of the transfix roller as the first inter-document zone and the second inter-document zone rotate through the nip.

* * * * *